United States Patent [19]

Bratkowski et al.

[11] Patent Number: 5,034,714

[45] Date of Patent: Jul. 23, 1991

[54] UNIVERSAL RELAY

[75] Inventors: Walter V. Bratkowski, McKeesport; James W. Miller, Murrysville, both of Pa.

[73] Assignee: Westinghouse Electric Corp., Pittsburgh, Pa.

[21] Appl. No.: 431,351

[22] Filed: Nov. 3, 1989

[51] Int. Cl.[5] ..... H01F 7/08

[52] U.S. Cl. ..... 335/234; 335/79

[58] Field of Search ..... 335/229, 230, 234, 78, 335/79, 80, 81

[56] References Cited

U.S. PATENT DOCUMENTS

| | | | |
|---|---|---|---|
| 1,750,895 | 3/1930 | Leyhausen | 335/186 |
| 2,323,702 | 7/1943 | Berkey | 335/2 |
| 3,023,286 | 2/1962 | Bourne et al. | 335/2 |
| 3,634,735 | 1/1972 | Komatsu | 335/234 X |
| 4,233,585 | 11/1980 | Sugimoto et al. | 335/262 |
| 4,253,493 | 3/1981 | English | 335/234 X |
| 4,550,302 | 10/1985 | Watanabe et al. | 335/234 X |
| 4,604,599 | 8/1986 | Koehler | 335/234 X |
| 4,751,487 | 6/1988 | Green | 335/230 X |

*Primary Examiner*—George Harris

[57] ABSTRACT

The relay of the present invention is economically adapted for nuclear and commercial applications. The reliability of the relay is enhanced by utilizing a split coil and a permanent magnet located therebetween. The so-called split coil/permanent magnet configuration supplements the upward forces generated by a kickout spring by positioning a permanent magnet so as to assist in holding the armature and contacts rigidly in the off position. The design of the present invention assures that the armature stays in the desired position even when the relay is subjected to shock and vibration forces present in the environment.

29 Claims, 3 Drawing Sheets

UNIVERSAL RELAY

BACKGROUND OF THE INVENTION

1. Field of Invention:

The invention is directed generally to safety equipment. In particular, the invention is directed to safety relay which maintains or locks the contacts of an electromechanical relay in the desired position.

2. Description of Related Art:

Reliability is an essential characteristic of safety equipment. Electromechanical relays are designed to operate the electrical circuits of safety equipment through a set of contacts. In such applications, the relay initiates a chain of events which brings the connected safety equipment to a safe state or stable condition. It is important that such relays maintain the equipment in the safe or stable condition until a change is positively initiated by the operator or computer.

Some commercial relays, as shown in FIGS. 1 and 2, employ a single coil 10, located within a magnetic frame 12, which when energized, draws an armature 14 and attached contacts (not shown) downwardly against the bias of a kickout spring 16. The armature 14 bottoms out on a lower or fixed pole 18 located on a central frame portion 20, which extends into the center of coil 10, as shown. A non-magnetic disc 22 is provided in order to reduce the hold down force on the fixed pole face 24 of the armature 14 to separate from the pole face 18 when the coil voltage is reduced to a predetermined value (e.g. 12 to 15 volts DC). In the position shown in FIG. 1 the electromagnetic forces generated by the coil 10, holds down the armature 14 and the electrical contacts (not shown) in the desired or closed position. When the coil 10 is de-energized (FIG. 2), the kickout spring 16 moves the armature 14 upward against the force of gravity to change the relay to its open position. In the design of such relays, when deenergized, the armature 14 is held in the up position only by the force of the kickout spring 16. Under such conditions the relay is susceptible to shock and vibration and may fail to maintain the contacts in the desired safe state.

SUMMARY OF THE INVENTION

The present invention includes a biased relay comprising a latchable armature which is movable when unlatched along its axis between the first and second positions. The relay further includes a magnetic means located in operative relation with the armature for magnetically latching the armature in the first or second position after the external voltage is removed. Electromagnetic means, in operative relation with both the magnetic means and the armature, neutralizes the magnetic means to unlatch the armature and also move the unlatched armature between the first and second position. In one embodiment of the relay, a first permanent magnet is utilized to maintain the armature in the first position and a second permanent magnet is utilized to maintain the armature when in the second position.

DESCRIPTION OF PREFERRED EMBODIMENT

Figure 2:
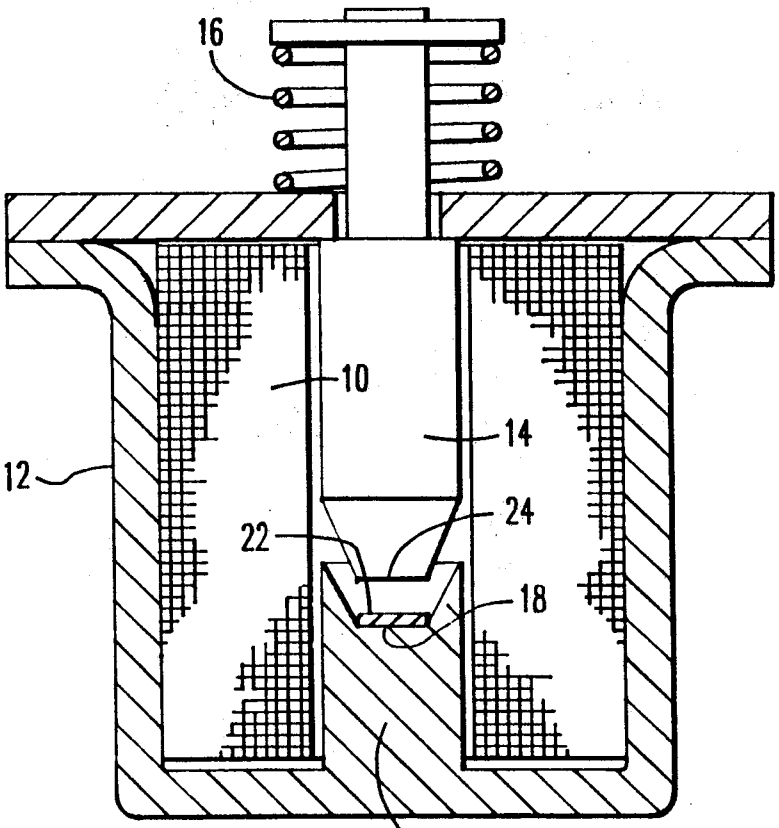
FIG. 2 PRIOR ART
FIG. 2 is a side sectional view of the relay device of FIG. 1 in the open position.

The relay 40 of the present invention includes a frame 42 and a latchable armature 44 movably mounted in the frame 42 along a central axis 46. The armature 44 is latchable in a first or up position (FIG. 3) and a second or down position (FIG. 4). In a preferred embodiment, the armature 44 has a pair of spaced annular recesses 52 and 54 formed therein. The armature 44 is formed of respective first and second magnetic portions 55 and 57 and an intermediate non-magnetic portion 59 which magnetically isolates the first and second portions 55 and 57 from each other. The first recess 52 and the second recess 54 are located respectively in the first or top magnetic portion 55 and the second or bottom magnetic portion 57 of the armature 44. The armature 44 also has a tapered end 56 with a flat pole face 58.

Figure 3:
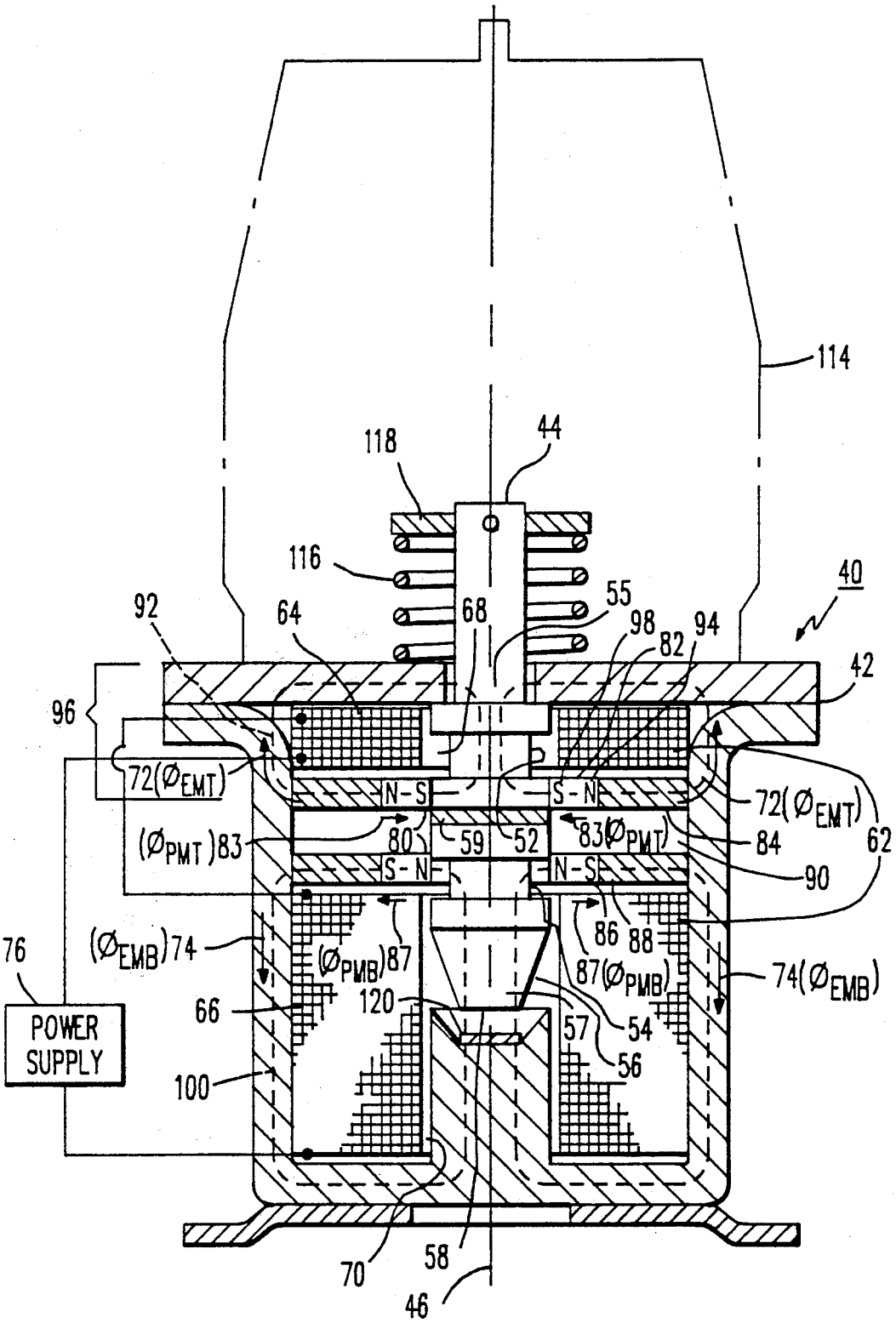
FIG. 3 is a side sectional view of a universal relay device according to the present invention in the up or open position; and, FIG. 4 is a side sectional view of a universal relay device according to the present invention in the down or closed position.
Figure 4:
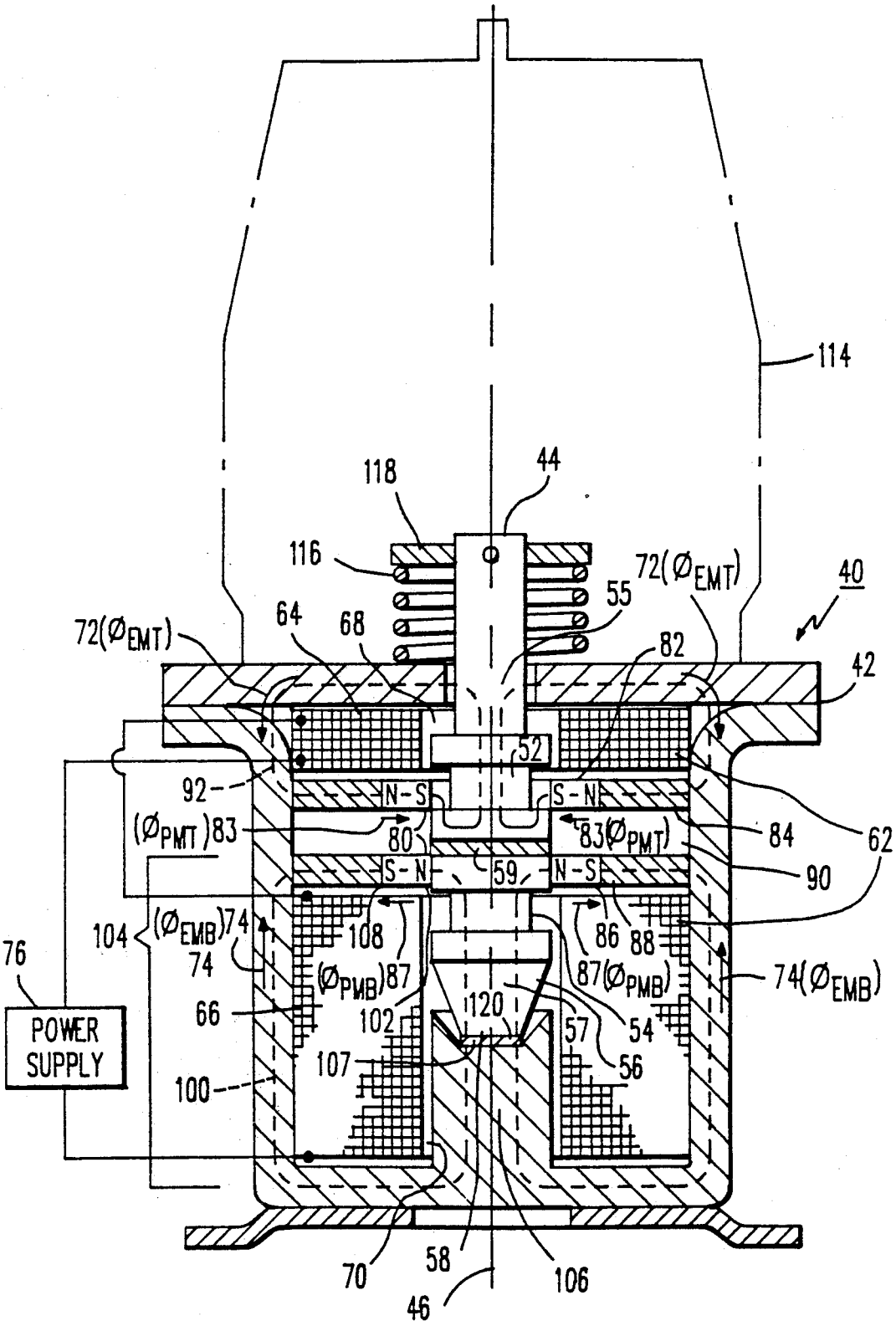

An electromagnetic coil means 62, mounted on the frame 42, is in operative relationship with the armature 44 for moving it between the respective first and second positions (FIGS. 3 and 4). The electromagnetic means 62 includes a first coil 64 and a second coil 66 which are mounted in the frame 42 one above the other in a spaced relationship. The first coil 64 has a central clearance 68 and the second coil 66 has a central clearance 70 which are concentric with the axis 46. The armature 44 moves in the central openings 68 and 70.

The first coil 64 is connected to provide a flux in the opposite direction to that of the second coil 66 so that when energized, the respective coils 64 and 66 produce top and bottom electromagnet fluxes represented by the arrows 72 ($\phi_{EMT}$) and 74 ($\phi_{EMB}$) which are of opposite polarity.

Magnetic means 80, located between the coils 64 and 66, is in an operative relationship for shifting the armature 44 in place. In a preferred embodiment, as illustrated in FIGS. 3 and 4, magnetic means 80 includes a first permanent magnet 82 and a second permanent magnet 86. The first magnet 82 is secured in the frame 42 at a position immediately below the first coil 64 by means of an annular magnetic disc 84. The second magnet 86, of opposite polarity from the first magnet 82, is secured in the frame 42 at a position immediately above the second coil 66 by means of a second annular disc 88. The first and second coils 64 and 66 are separated by an air gap 90 (or non-metal material) formed between the discs 84 and 88.

In accordance of the preferred embodiment of the present invention, the armature 44 is mounted vertically along the axis 46 for movement up and down in the clearances 68 and 70 of the first and second coils 64 and 66. The upper end of the armature 44 is adapted to actuate a plurality of electrical contacts (not shown) enclosed in the contact housing 114 mounted atop the frame 42. The armature 44 is biased by a concentric spring 116 which is captured between the frame 42 and a radial projection 118 extending from the top of the armature 44.

When the armature 44 is in the first position (FIG. 3) the first magnet 82 is in close proximity with the upper portion 55 of the armature 44 to thereby magnetically latch it in place by completing the upper magnetic circuit 92 (illustrated by the dotted line). Magnetic circuit 92 flows from one permanent magnet pole 94 of the first magnet 82 through the first disc 84, through the frame portion 96 adjacent the first coil 64, the upper portion of the armature 44 and to the other pole 98 of the first magnet 82. When the armature 44 is in the up or first position (FIG. 3), the second magnet 86 is aligned with the second notch 54 of the lower part 57 of the armature 44 and is thus magnetically isolated from the armature 44 and has little or no effect thereon.

In the preferred embodiment, when the armature 44 is down or in the second position (FIG. 4), the second magnet 86 is in close proximity with the lower portion 57 of the armature 44 to thereby magnetically latch it in place. As shown in FIG. 4, the armature 44 is latched in the second position by completing the lower magnetic circuit 100, shown as a dotted line, extending from the North pole 102 of the second magnet 86 through the frame portion 104 adjacent to second coil 66 and through a central frame portion 106 including pole face 107 which is in confronting relationship with the pole face 58 of the armature 44, to the other pole 108 of the second magnet 86. It should be noted that the fluxes 72 ($\phi_{EMT}$) and 74 ($\phi_{EMB}$) in the magnetic circuits 92 and 100 have directional arrow heads associated therewith to designate their opposite plurality depending on the state of the relay 40.

A nonmagnetic disc 120 is mounted on the central pole face 107 of the frame 42 in confronting relationship with the flat pole face 58 of the armature 44. The nonmagnetic disc 120 regulates the voltage/flux necessary to release the armature 44 from the second to the first position under the influence of the first coil 64 and biasing spring 116. It should be understood that in accordance with the present invention the coils 64 and 66 are sized for producing sufficient magnetic fluxes 72 ($\phi_{EMT}$) and 74 ($\phi_{EMB}$) for moving the armature 44 between the first and second position in opposition to the force of gravity and the bias of spring 116.

In order to operate the relay 40, it is necessary to pulse the source 76 to a first polarity to thereby momentarily energize the electromagnetic means 62 (which includes coils 64 and 66) to first magnetically unlock the armature 44 and simultaneously move or pull the armature 44 to the opposite position. For example, when the relay 40 is in the first position (FIG. 3) the electromagnetic means 62 is momentarily pulsed or energized, causing the first coil 64 to produce flux 72 ($\phi_{EMT}$) which is in the opposite sense to the polarity of the first or top permanent magnet 82 in the first magnetic circuit 92 thus neutralizing the magnetic attraction produced by the first magnet 82 and thereby releasing the magnetic latch. At the same time, the second coil 66, serially connected to the first coil 64, produces flux 74 ($\phi_{EMB}$) which pulls the armature 44 down or into the second position as shown in FIG. 4. When the armature 44 comes to rest in the second position (FIG. 4), the second permanent magnet 86 latches the armature 44 into position as described above. Note that when the second coil 66 pulls in the armature 44 from the first position (FIG. 3) to the second position (FIG. 4), the flux 74 ($\phi_{EMB}$) produced thereby is acting in the same sense as the polarity 87 ($\phi_{PMB}$) of the second or bottom permanent magnet 86 and thereby assists it in latching the armature 44 as long as it is energized. When the armature 44 is pulled into the second position (FIG. 4), the first magnet 82 is aligned with the first notch 5 and is thus magnetically isolated from the armature 44 and therefore does not significantly affect it.

In order to move the relay from the second position (FIG. 4) back to the first position (FIG. 3) the power source 76 is momentarily pulsed or reversed in a second polarity opposite to the first. Accordingly, the second coil 66 produces flux 74 ($\phi_{EMB}$) which is now opposite in sense to the polarity 87 ($\phi_{PMB}$) of the second magnet 86, thus neutralizing the magnetic latch and thereby releasing the armature 44. At the same time, the first coil 64 produces flux 72 ($\phi_{EMT}$) which urges the armature 44 back towards the first position (FIG. 3). Further, because the flux 72 ($\phi_{EMT}$) is now acting in the same sense as the polarity 83 ($\phi_{PMT}$) of the first magnet 82, the flux 72 ($\phi_{EMT}$) helps to latch the relay once the armature 44 has moved back to the first position (FIG. 3). The first or top magnet 82 maintains the magnetical latch on the armature 44 once it is in place.

Figure 1:
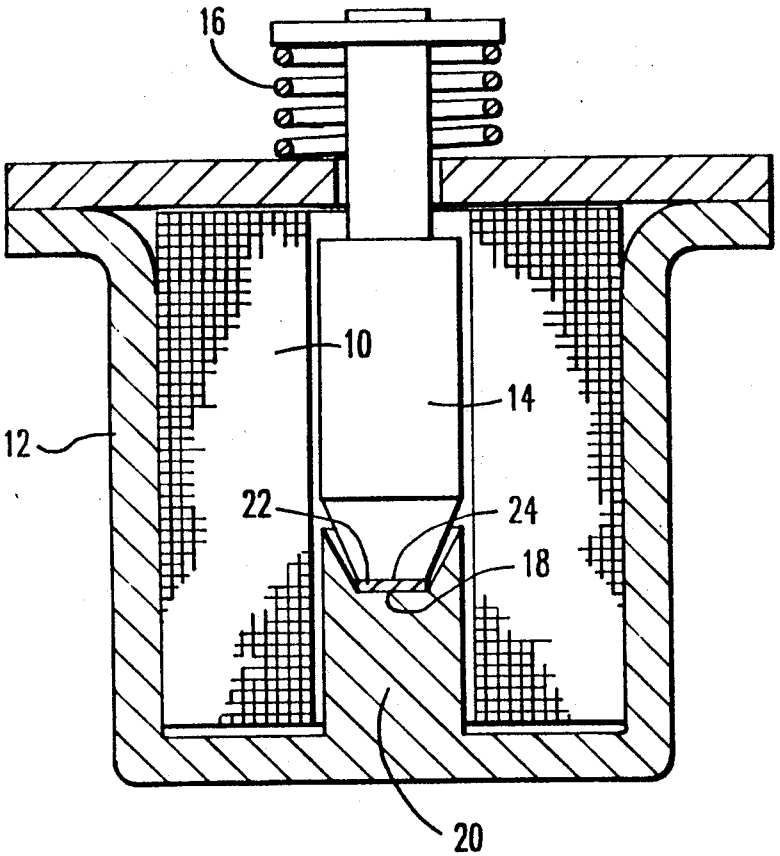
FIG. 1 PRIOR ART
FIG. 1 is a side sectional view of a prior art relay device in the closed position.

In the present invention, the total coil resistance of the relay 40 is the sum of the resistance of the upper coil 64 and the resistance of the lower coil 66. Consequently, the temperature rise within the relay 40, resulting from Joule heating of the coils 64 and 66, may be tailored so that it does not exceed safety standards. For example, the total resistance of the coils 64 and 66 may be the same as that of the single coil 10 used in the relay illustrated in FIGS. 1 and 2.

In addition, because the coils are only momentarily energized by pulsing the power supply 76 the heat generated by the electrical resistance of the coils is very low. Also, in accordance with the present invention, because the relay 40 may be latched in the respective upper and lower positions by the permanent magnets 82 and 86, a current need not be maintained in the relay coils 64 and 66 at all times in order to maintain the armature in place. Thus, a source of Joule heating is thereby eliminated.

Although the present invention has been described in terms of what are presently believed to be its preferred embodiments, it will be apparent to those skilled in the art that various changes may be made without departing from the scope of the invention. It is therefore intended that the appended claims cover such changes.

What is claimed is:

1. A biased relay comprising:

a latchable armature movable when unlatched along its axis between first and second positions and having at least one recess forming an air gap movable with armature;

magnetic means located in operative relation with the armature and the corresponding air gap for magnetically latching said armature in at least one of said first and second positions when the magnetic means is aligned proximate the armature and the air gap is axially displaced with respect to the air gap; and electromagnetic means in operative relation with the magnetic means and the armature for magnetically neutralizing the magnetic means to unlatch the armature and for moving the unlatched armature between the first and second positions.

2. The relay of claim 1 wherein the armature is cylindrical and the recess is an annular slot formed in a wall portion of said armature.

3. The relay of claim 1 wherein the magnetic means includes at least one permanent magnet.

4. The relay of claim 1 wherein said electromagnetic means includes first and second electromagnetic coils each having a central opening and being located along a common axis of said openings and concentric with the armature axis, the first and second coils are for producing independent magnetic fluxes when sufficiently energized for moving the armature to the first and second positions, respectively.

5. The relay of claim 4 wherein said magnetic means includes a first magnetic means located in operative relation with the armature for magnetically supporting said armature in the first position when the first coil is insufficiently energized.

6. The relay of claim 5 wherein the first coil is operative, when energized in a selected first polarity, to produce a magnetic flux for counteracting the magnetic support provided by the first magnetic means, and to urge the armature towards the second position.

7. The relay of claim 6 wherein the armature has a first annular recess forming a first air gap, said first air gap being movable with the armature out of alignment with the first magnetic means when the armature is in the first position.

8. The relay of claim 7 wherein said magnetic means includes a second magnetic means located in operative relation with the armature for magnetically supporting said armature in the first position when the second coil is insufficiently energized.

9. The relay of claim 8 wherein the second coil is operative, when energized to a polarity opposite said first polarity, to produce a magnetic flux for counteracting the magnetic support provided by the magnetic means when the armature is in the second position, and to urge the armature back towards the first position.

10. The relay of claim 8 wherein the first coil, when energized, assists in magnetically latching the relay in the second position and the second coil assists in latching the relay in the first position.

11. The relay of claim 9 wherein the armature has a second annular recess forming a second air gap, said second air gap being movable with the armature out of alignment with the second magnetic means when the armature is in the second position, said second air gap being movable into alignment with the second magnetic means when the armature is in the second position.

12. The relay of claim 11 wherein the armature is segmented for isolating the magnetic flux generated by the first coil from the magnetic flux generated by the second coil.

13. The relay of claim 12 wherein the armature is segmented by a layer of non-magnetic material.

14. The relay of claim 4 further including upper and lower magnetically permeable annular disks separated by an air gap, for carrying the magnetic flux generated by the first and second coil, positioned such that an upper disk is immediately below the first coil and such that the lower disk is immediately above the second coil.

15. A universal relay comprising:

at least two coils, including an upper coil and a lower coil for producing respective magnetic fluxes when energized;

a magnetic flux control means located between said upper and lower coil for regulating the interaction between fluxes generated by the upper and lower coils; and an armature surrounded by the upper and lower coils and the magnetic flux control means for moving vertically to open and close the relay.

16. The relay according to claim 15 further including a pair of circular layers of steel for carrying the magnetic flux generated by the two coils and positioned such that an upper layer of steel is immediately below the upper coil, and such that a lower layer of steel is immediately above the lower coil and wherein the upper and lower layers of steel are separated by an air gap.

17. The relay according to claim 16 further including a first annular permanent magnet located along the inner periphery of the lower layer of steel for supporting the armature in the closed position.

18. The relay according to claim 16 further including a second annular permanent magnet located along the inner periphery of the upper layer of steel for supporting the armature in the open position.

19. The relay according to claim 16 wherein the armature has a layer of non-magnetic material therein, said non-magnetic material being located in alignment with the air gap between the upper and lower layers of steel.

20. The relay according to claim 16 wherein the armature has a first indented notch around its outer periphery which is alignable with the first permanent magnet and the lower coil.

21. The relay according to claim 16 wherein the armature has an indented notch around its outer periphery which is alignable with the permanent magnet and the upper coil.

22. The relay according to claim 15 further comprising:

a non-magnetic material on an electromagnetic pole face located at the lowest point of the travel path of the armature.

23. The relay according to claim 15 further comprising means for applying a normally upward force against the armature.

24. The relay according to claim 23 wherein the normally upward force against the armature is generated by a kickout spring.

25. The relay according to claim 15 wherein the armature is movable vertically between the open and closed positions and the magnetic flux control means includes permanent magnet means for sustaining the armature either in the upper or lower position upon deenergization of the coils.

26. The relay according to claim 15 wherein the respective upper and lower coils are normally deenergized and the magnetic flux control means includes permanent magnet means for sustaining the armature in one of the opened or closed positions when said coils are deenergized.

27. The relay according to claim 26 wherein the respective coils are momentarily energized to opposite polarities for moving the armature between the respective upper and lower positions.

28. A biased relay comprising:

a latchable armature having magnetically separate armature sections and being axially movable when unlatched between first and second positions, each armature section having an annular recesses forming spaced apart air gaps;

a pair of axially spaced permanent magnets located in operative relation with a corresponding armature sections and air gap for magnetically latching the armature when one of the magnets is aligned proximate the corresponding armature section and the other air gap is axially displaced with respect to its corresponding magnet; and a pair of electromagnets in operative relationship with a corresponding one of the permanent magnets and the armature sections, each electromagnet for neutralizing the corresponding permanent magnet latching the armature to thereby unlatch it and for moving armature between the first and second positions.

29. A biased relay comprising:

a latchable armature movable when unlatched along its axis between first and second positions;

magnetic means located in operative relationship with the armature for magnetically latching said armature in at least one of said first and second positions;

a pair of electromagnetic means in operative relationship with the magnetic means and the armature, each one energized for producing independent magnetic fluxes for magnetically neutralizing the magnetic means to unlatch the armature and for moving the unlatched armature between the first and second positions; and first and second magnetically permeable means separated by an air gap for carrying the magnetic flux generated by the respective first and second electromagnetic means, being positioned such that first magnetically permeable means is located adjacent the first electromagnetic means for carrying the flux produced thereby and the second magnetically permeable means is located adjacent the second electromagnetic means for carrying the flux produced thereby.

* * * * *